US011905108B2

(12) United States Patent
Brigham

(10) Patent No.: US 11,905,108 B2
(45) Date of Patent: Feb. 20, 2024

(54) METHOD OF CREATING A STAND-OFF BETWEEN INSULATION AND A CHIME ON A STORAGE TANK

(71) Applicant: Integrity Products & Supplies Inc., Sherwood Park (CA)

(72) Inventor: Graham Brigham, Sherwood Park (CA)

(73) Assignee: INTEGRITY PRODUCTS & SUPPLIES INC., Sherwood Park (CA)

( * ) Notice: Subject to any disclaimer, the term of this patent is extended or adjusted under 35 U.S.C. 154(b) by 0 days.

(21) Appl. No.: 18/192,134

(22) Filed: Mar. 29, 2023

(65) Prior Publication Data

US 2023/0312232 A1 Oct. 5, 2023

(30) Foreign Application Priority Data

Mar. 31, 2022 (CA) ..... CA 3153909

(51) Int. Cl.
*B65D 90/02* (2019.01)
*B65D 88/08* (2006.01)

(52) U.S. Cl.
CPC ..... *B65D 90/028* (2013.01); *B65D 88/08* (2013.01)

(58) Field of Classification Search
CPC ..... B65D 90/028; B65D 88/08
See application file for complete search history.

(56) References Cited

PUBLICATIONS https://web.archive.org/web/20210518175715/https://www.integrity-products.com/uploads/source/PDFs/20-12_TankSpacer-TDS.pdf (Year: 2021).*

* cited by examiner

*Primary Examiner* — Moshe Wilensky
(74) *Attorney, Agent, or Firm* — Finch & Maloney PLLC

(57) ABSTRACT

A method of creating a stand-off between insulation and chime on a storage tank is provided. A plurality of tank chime spacers are positioned in space relation to each other such that the bottom of the tank chime spacer is positioned on the tank chime and one of the peripheral side walls of the tank chime spacer is positioned adjacent to the sidewalls of the storage tank to create a gap between the tank chime and the sidewalls of the storage tank. Each of the tank chime spacers has a body with a top, a bottom and peripheral side walls.

9 Claims, 3 Drawing Sheets

METHOD OF CREATING A STAND-OFF BETWEEN INSULATION AND A CHIME ON A STORAGE TANK

FIELD OF THE DISCLOSURE

The present application relates generally to method of creating a stand-off between insulation and chime on storage tanks, and more particularly relates to method of reducing corrosion in insulated storage tanks having tank chimes by creating a stand-off.

BACKGROUND

This section provides background information to facilitate a better understanding of the various aspects of the invention. It should be understood that the statements in this section of this document are to be read in this light, and not as admissions of prior art.

Insulated storage tanks are susceptible to corrosion under insulation and consequential failures due to loss of containment. The problem begins when moisture ingress in the storage tank's insulation moves vertically down alongside the tank shell and collects at the bottom over the tank chime, around the shell plate, and the weld joints. The weld junction between shell and bottom plate is highly prone to failure due to corrosion because it experiences the maximum fluid load. Moreover, the weld junction is generally non-accessible for insulated storage tanks which hinders the ability to make regular inspections of this critical portion of the storage tank. Not every storage tank is provided with a Dike wall, which can result in significant consequences and spillage in the event of tank leaks. There is, therefore, a need to keep the moisture off this weld junction to avoid corrosion and create the opportunity to conduct visual and non-destructive examination of this critical zone on the insulated storage tanks. Otherwise, the moisture becomes trapped and causes corrosion under insulation which goes unnoticed resulting in costly tank failures.

BRIEF SUMMARY

There is provided a method of creating a stand-off between insulation and chime on a storage tank and a tank chime by providing a plurality of tank chime spacers. Each of the tank chime spacers has a body that has a top, a bottom, and peripheral side walls. The plurality of tank chime spacers are positioned in spaced relation around a wall of the storage tank and over the tank chime such that the bottom of each of the tank chime spacers contacts the tank chime spacer and one of the peripheral side walls of the tank chime spacer is positioned adjacent to a sidewall of the storage tank such that a gap is created between the tank chime spacer and the wall of the storage tank.

In one embodiment, the bottom of each of the tank chime spacers has a corrugated shape such that at least one drain is created at the bottom of each of the tank chime spacers such that moisture passes through the at least one drain.

In one embodiment, the plurality of tank chime spacers are spaced equidistant from each other.

In one embodiment, the plurality of tank chime spacers are spaced 12 inches from each other.

In one embodiment, each of the tank chime spacers are fastened adjacent to a bottom of the wall of the storage tank.

In one embodiment, each of the tank chime spacers are fastened to an insulation channel of the storage tank.

In one embodiment, each of the tank chime spacers is made of a high temperature silicone rubber.

In one embodiment, the body of each of the tank chime spacers is solid.

In one embodiment, the insulation is supported by a combination of tank chime spacer and insulation support channel.

In one embodiment, the insulation channel is perforated to allow for drainage of trapped moisture.

BRIEF DESCRIPTION OF THE DRAWINGS

These and other features will become more apparent from the following description in which references are made to the following drawings, in which numerical references denote like parts. The drawings are for the purpose of illustration only and are not intended to in any way limit the scope of the invention to the particular embodiments shown.

DETAILED DESCRIPTION OF THE PREFERRED EMBODIMENTS

A method of creating a stand-off between insulation and chime on a storage tank will now be described with reference to FIG. 1 through FIG. 4.

Figure 1:
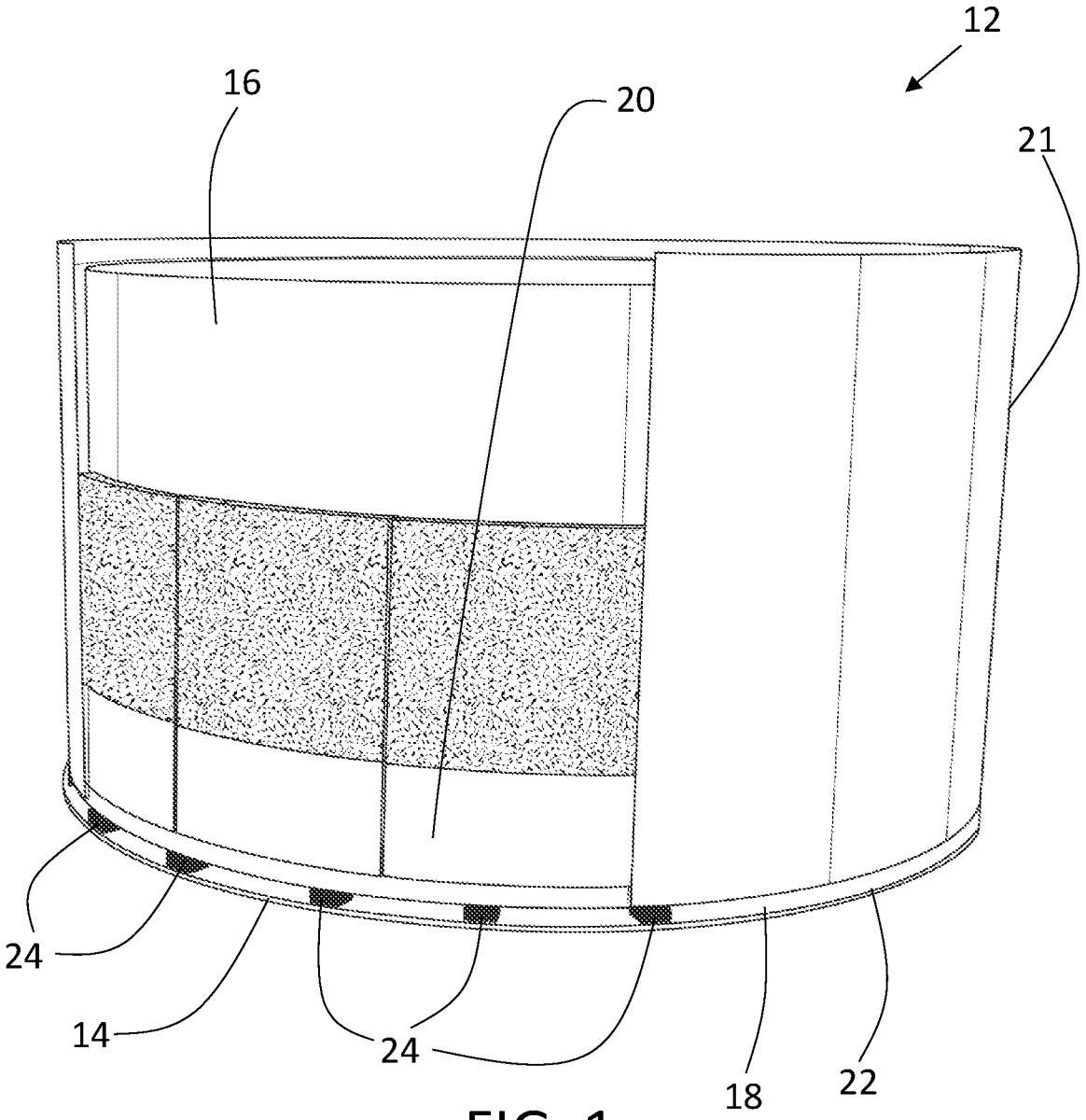
FIG. 1 is a perspective view, partly in section, of a storage tank having a tank chime with tank chime spacers.

Referring to FIG. 1, a storage tank 12 has a bottom 14, sidewalls 16, an insulation channel 18 that houses insulation 20, and a tank chime 22. An outer cladding 21 is positioned exterior to insulation 20 to provide protection to insulation 20 from the elements. Insulation 20 is positioned between outer cladding 21 and sidewalls 16 of storage tank 12. Outer cladding 21 may be removable and replaceable as needed. Tank chime 22 is generally the protruded portion of flat annular or bottom plate of storage tank 12 and serves as the interface between sidewalls 16 and a storage tank foundation, not shown. In the embodiment shown, tank chime 22 is an extension of bottom 14 of storage tank, however it will be understood that tank chime 22 can be a separate annular ring surrounding sidewalls 16 and extending from bottom 14. Tank chime 22 may be welded to storage tank 12. Tank chime 22 helps to stabilize storage tank 12 by transferring radial forces from sidewalls 16 to storage tank foundation. Without proper mitigation, tank chime 22 generally tends to develop significant corrosion which can lead to failure and loss of containment. It will be understood by a person of skill in the art that the term storage tank can be broadly interpreted to include tanks, vessels, and any other containment device known to a person skilled in the art.

Figure 2:
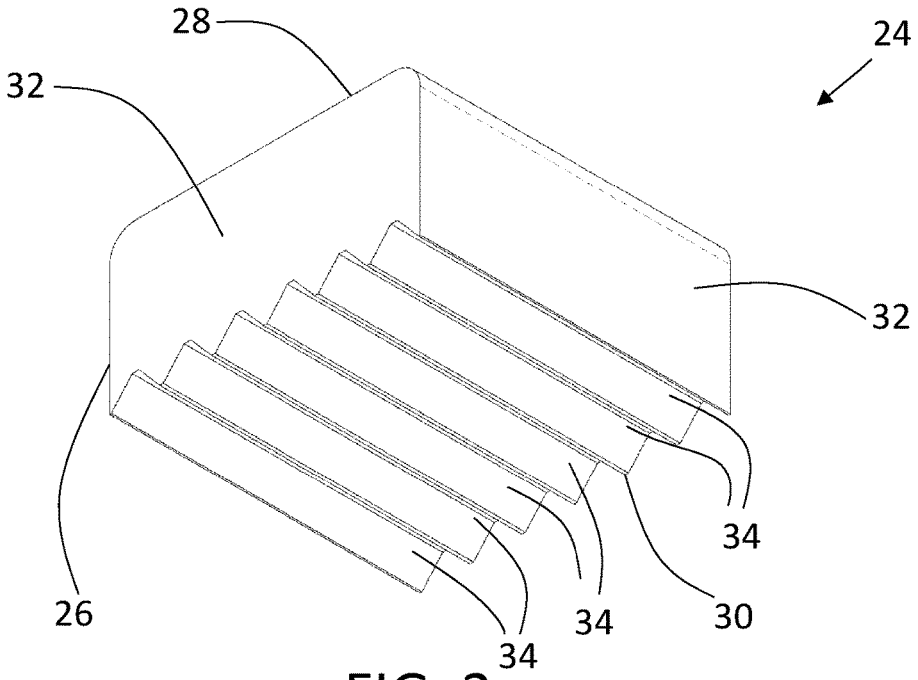
FIG. 2 is a perspective view of a tank chime spacer.
Figure 3:
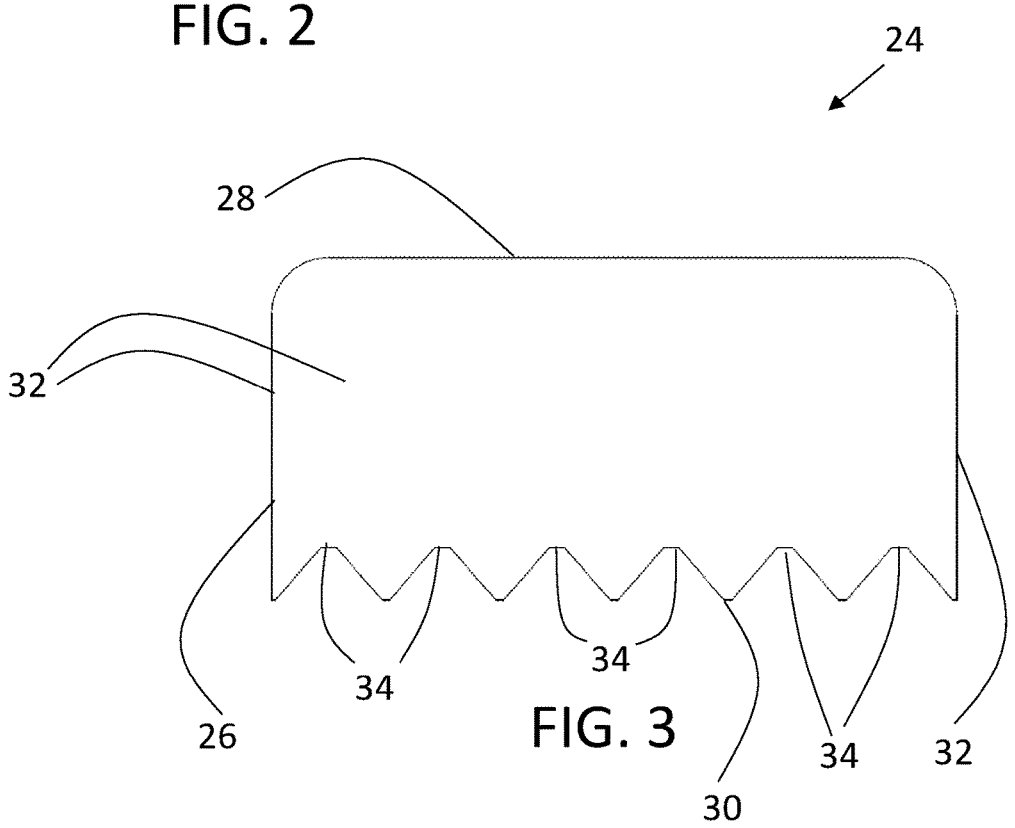
FIG. 3 is a side elevation view of the tank chime spacer shown in FIG. 2.

Referring to FIG. 2 and FIG. 3, tank chime spacers 24 have a body 26 that has a top 28, a bottom 30, and peripheral side walls 32. In the embodiment shown, tank chime spacer 24 is generally rectangular in shape and has four peripheral side walls 32. It will be understood by a person skilled in the art that the shape of tank chime spacers 24 may be any shape, including but not limited to triangles, quadrilaterals, circles, octagons, decagons, and any other polygon shapes. In the embodiments shown, bottom 30 has a corrugated shape that creates drains 34 that allow moisture to pass along bottom 30 of tank chime spacer 24. In the embodiments shown, tank chime spacer 24 has six drains 34 created by the corrugated shape. It will be understood by a person skilled in the art that a different number of drains 34 may be present. It will also be understood by a person skilled in the art that these drains are not required and that simply spacing tank chime spacers 24 apart from each other also creates spaces through which moisture may pass. The addition of drains 34 help to prevent the risk of moisture becoming stuck or stagnant under and around storage tank 12 and tank chime spacers 24. Tank chime spacers 24 may be made of any suitable material that is not prone to rusting and corrosion. Non-metals are generally preferred as this prevents potential issues related to metal-on-metal contacts, however it will be understood that a coating could be used over a metal body to overcome this potential issue. High temperature silicone rubber is a preferred material for tank chime spacers 24. It is preferred that body 26 be solid to prevent collapsing of top 28 due to weight, however it will be understood that a suitably supported hollow body may also be used.

Figure 4:
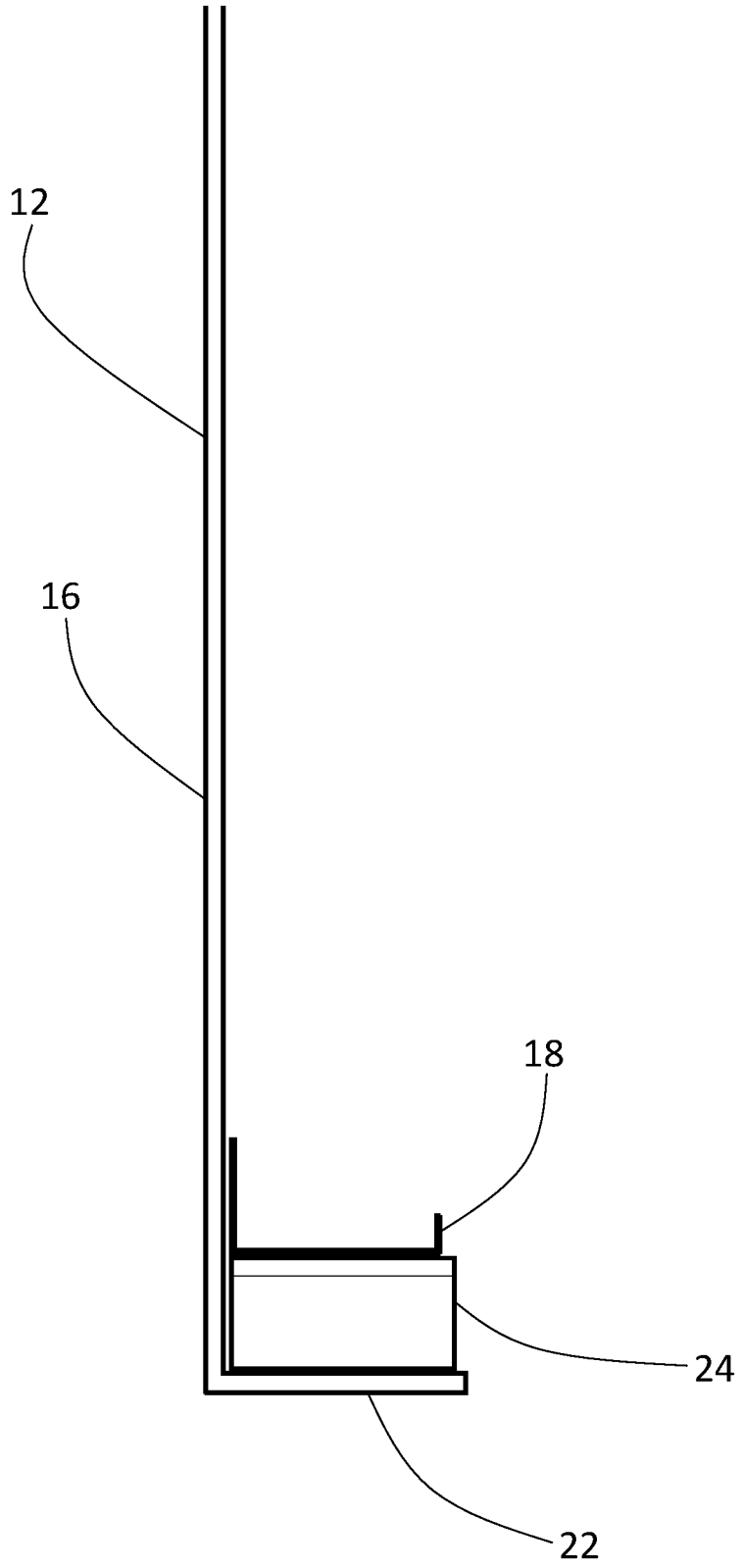
FIG. 4 is a side elevation view of a tank chime spacer positioned on a storage tank.

Referring to FIG. 4, a plurality of tank chime spacers 24 are positioned such that bottom 30 is positioned on tank chime 22 and one of peripheral side walls 32 abuts sidewalls 16 to create a stand-off between tank chime 22 and insulation 20. Maintaining a stand-off helps to prevent buckling of tank chime spacer 22 that can occur over time and result in moisture pooling in low spots, which can cause corrosion, rusting and damage to storage tank 12. Referring to FIG. 1, in the embodiment shown, tank chimer spacers 24 are positioned equidistant to each other along the entire circumference of storage tank 12. The distance between tank chime spacers 24 may vary, however a spacing of 12 inches between tank chime spacers 24 may be beneficial. Providing spacing between tank chime spacers 24 allows for moisture to pass between adjacent thank chime spacers 24 to prevent accumulation of moisture that can cause corrosion. To prevent movement of tank chime spacers 24, tank chime spacers 24 may be fastened adjacent to sidewall 16. This creates a horizontal stand-off between tank chime spacer 24 and sidewall 16 to assist drainage of accumulated or trapped moisture before it can cause significant corrosion on tank chime 22 and weld joints. Insulation 20 may be prevented from contacting both tank chime 22 and tank chime spacers 24 of storage tank 12 by virtue of insulation channel 18 which may be made perforated to help with drainage of trapped moisture in insulation 20. Insulation channel 18 may provide reinforcement via homogenous distribution of forces caused from insulation 20 load. Tank chime spacers 24 may also be fastened to the bottom of insulation channel 18. This can be done before insulation 20 for new installations of insulations. For existing insulations, tank chime spacers 24 can be retrofitted into insulation channel 18 by first removing outer cladding 21 and insulation 20, followed by the installation of tank chime spacers 24 and re-installation of insulation 20 and outer cladding 21. As can be seen in FIG. 1, outer cladding 21 may rest on tank chime spacers 24. This helps to prevent direct contact between outer cladding 21 and tank chime 22 and eliminates a potential contact point for corrosion and damage.

Creating a stand-off using tank chime spacers 24 helps to mitigate the risk of corrosion under insulation and related damage mechanisms in insulated storage tanks. In addition, a stand-off created by tank chime spacers 24 can allow for inspection of a bottom of storage tank 12 which can identify potential issues before a catastrophic failure of storage tank and loss of containment.

Any use herein of any terms describing an interaction between elements is not meant to limit the interaction to direct interaction between the subject elements and may also include indirect interaction between the elements such as through secondary or intermediary structure unless specifically stated otherwise.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent that changes may be made to the illustrative embodiments, while falling within the scope of the invention. As such, the scope of the following claims should not be limited by the preferred embodiments set forth in the examples and drawings described above but should be given the broadest interpretation consistent with the description as a whole.

What is claimed is:

1. A method of creating a stand-off between insulation and tank chime on a storage tank, the method comprising the steps of:

providing a plurality of tank chime spacers, and each of the tank chime spacers having a body with a top, a bottom and peripheral side walls;

positioning the plurality of tank chime spacers in spaced relation such that the bottom of the tank chime spacer is positioned on the tank chime, one of the peripheral side walls of the tank chime spacer being positioned against a sidewall of the storage tank, the top of the tank chime spacer being positioned adjacent an insulation channel, and the plurality of tank chime spacers being positioned such that a gap is formed between the tank chime spacer and the insulation channel of the storage tank; and each of the tank chime spacers being fastened to a bottom of the sidewall of the storage tank.

2. The method of claim 1 wherein the bottom of each of the tank chime spacers has a corrugated shape such that at least one drain is created at the bottom of each of the tank chime spacers such that moisture passes through the at least one drain.

3. The method of claim 1 wherein the plurality of tank chime spacers are spaced equidistant from each other.

4. The method of claim 3 wherein the plurality of tank chime spacers are spaced 12 inches from each other.

5. The method of claim 1 wherein each of the tank chime spacers are fastened to an insulation base channel of the storage tank.

6. The method of claim 1 wherein each of the tank chime spacers is made of a high temperature silicone rubber.

7. The method of claim 1 wherein the body of each of the tank chime spacers is solid.

8. The method of claim 1 wherein the insulation is supported by a combination of tank chime spacer and insulation support channel.

9. The method of claim 8 wherein the insulation channel is perforated to allow for drainage of trapped moisture.

* * * * *